US008455749B1

(12) United States Patent
Gage et al.

(10) Patent No.: US 8,455,749 B1
(45) Date of Patent: Jun. 4, 2013

(54) DETACHABLE ELECTRIC PICKUP FOR MUSICAL INSTRUMENT

(76) Inventors: David Rowland Gage, New York, NY (US); Richard Ned Steinberger, Nobleboro, ME (US)

( * ) Notice: Subject to any disclaimer, the term of this patent is extended or adjusted under 35 U.S.C. 154(b) by 191 days.

(21) Appl. No.: 12/927,274

(22) Filed: Nov. 10, 2010

Related U.S. Application Data

(60) Provisional application No. 61/281,363, filed on Nov. 16, 2009.

(51) Int. Cl.
*G10H 3/12* (2006.01)

(52) U.S. Cl.
USPC ..... 84/730; 84/731

(58) Field of Classification Search
USPC ..... 84/730–732
See application file for complete search history.

(56) References Cited

U.S. PATENT DOCUMENTS

| | | | | | |
|---|---|---|---|---|---|
| 2,222,057 | A | * | 11/1940 | Benioff | 84/729 |
| 2,944,117 | A | * | 7/1960 | Gray | 369/137 |
| 3,186,237 | A | * | 6/1965 | Forrest | 73/514.34 |
| 3,291,887 | A | * | 12/1966 | Carman et al. | 84/731 |
| 3,507,972 | A | * | 4/1970 | Istvan | 84/731 |
| 3,624,264 | A | * | 11/1971 | Lazarus | 84/730 |
| 3,725,561 | A | * | 4/1973 | Paul | 84/726 |
| 3,733,425 | A | * | 5/1973 | Chaki | 84/731 |
| 4,030,396 | A | * | 6/1977 | Mariner | 84/731 |
| 4,058,045 | A | * | 11/1977 | Jennings et al. | 84/731 |
| 4,084,473 | A | * | 4/1978 | Kitashima et al. | 84/731 |
| 4,147,084 | A | * | 4/1979 | Underwood | 84/731 |
| 4,168,647 | A | * | 9/1979 | Petillo | 84/731 |
| 4,189,969 | A | * | 2/1980 | Katayama et al. | 84/731 |
| 4,278,000 | A | * | 7/1981 | Saito et al. | 84/731 |
| 4,356,754 | A | * | 11/1982 | Fishman | 84/731 |
| 4,441,370 | A | * | 4/1984 | Sakurada | 73/651 |
| 4,450,744 | A | * | 5/1984 | Shubb | 84/731 |
| 4,860,625 | A | * | 8/1989 | Mathews | 84/731 |
| 4,899,636 | A | * | 2/1990 | Chiba et al. | 84/454 |
| 4,984,498 | A | * | 1/1991 | Fishman | 84/730 |
| 5,123,325 | A | * | 6/1992 | Turner | 84/731 |
| 5,134,920 | A | * | 8/1992 | Clark | 84/730 |
| 5,206,449 | A | * | 4/1993 | McClish | 84/723 |
| 5,237,126 | A | * | 8/1993 | Curtis et al. | 84/724 |
| 5,911,171 | A | * | 6/1999 | Wong | 84/731 |
| 5,925,839 | A | * | 7/1999 | Schertler | 84/298 |
| 5,990,403 | A | * | 11/1999 | Membreno et al. | 84/454 |
| 6,274,801 | B1 | * | 8/2001 | Wardley | 84/731 |
| 7,034,218 | B1 | * | 4/2006 | Lazarus et al. | 84/723 |
| 7,049,502 | B2 | * | 5/2006 | Taku et al. | 84/454 |
| 7,132,597 | B2 | * | 11/2006 | Hosler | 84/723 |
| 7,196,261 | B2 | * | 3/2007 | Suenaga | 84/730 |
| 7,285,713 | B2 | * | 10/2007 | Takabayashi | 84/723 |
| 7,319,188 | B1 | * | 1/2008 | Birkhamshaw et al. | 84/731 |
| 7,339,106 | B2 | * | 3/2008 | Tamura | 84/723 |
| 7,368,654 | B1 | * | 5/2008 | Wai et al. | 84/723 |
| 7,446,255 | B2 | * | 11/2008 | Yamaya | 84/731 |
| 7,453,040 | B2 | * | 11/2008 | Gillette | 84/723 |
| 7,595,443 | B2 | * | 9/2009 | Yagi | 84/600 |
| 7,667,128 | B2 | * | 2/2010 | Hosler | 84/723 |

(Continued)

*Primary Examiner* — David S. Warren
(74) *Attorney, Agent, or Firm* — Saul Epstein

(57) ABSTRACT

A detachable (portable) electrical pickup for musical instruments, such as basses, that includes a clamp to secure the pickup to the bridge of an instrument, a piezo crystal sensor, an integral audio jack, and a volume control. Also included are musician removable and interchangeable weights that are used to alter the response characteristics and to control any deleterious feedback.

17 Claims, 3 Drawing Sheets

U.S. PATENT DOCUMENTS

| | | | | |
|---|---|---|---|---|
| 7,804,018 | B2 * | 9/2010 | Tamura | 84/731 |
| 7,968,778 | B2 * | 6/2011 | D'Addario et al. | 84/312 R |
| 8,008,559 | B1 * | 8/2011 | Ward et al. | 84/313 |
| 8,088,988 | B2 * | 1/2012 | Randazzo | 84/723 |
| 8,389,841 | B1 * | 3/2013 | Stevens | 84/410 |
| 2001/0002570 | A1 * | 6/2001 | McCabe | 84/312 R |
| 2002/0162443 | A1 * | 11/2002 | Pittman | 84/453 |
| 2003/0047061 | A1 * | 3/2003 | Kugimoto et al. | 84/433 |
| 2003/0140767 | A1 * | 7/2003 | Yagi | 84/454 |
| 2003/0188629 | A1 * | 10/2003 | Suenaga | 84/723 |
| 2004/0159224 | A1 * | 8/2004 | Raisanen | 84/730 |
| 2004/0159225 | A1 * | 8/2004 | Barr | 84/743 |
| 2004/0255762 | A1 * | 12/2004 | Takabayashi | 84/730 |
| 2005/0011342 | A1 * | 1/2005 | Fishman | 84/730 |
| 2005/0076767 | A1 * | 4/2005 | McCabe | 84/313 |
| 2005/0087060 | A1 * | 4/2005 | Taku et al. | 84/455 |
| 2005/0087062 | A1 * | 4/2005 | Kiyohiko | 84/723 |
| 2005/0155482 | A1 * | 7/2005 | Takegawa | 84/422.1 |
| 2005/0188814 | A1 * | 9/2005 | Bell et al. | 84/298 |
| 2005/0257670 | A1 * | 11/2005 | Takabayashi | 84/730 |
| 2006/0042454 | A1 * | 3/2006 | Tamura | 84/730 |
| 2006/0283311 | A1 * | 12/2006 | Hosler | 84/723 |
| 2007/0163418 | A1 * | 7/2007 | Allred | 84/291 |
| 2007/0245884 | A1 * | 10/2007 | Yamaya | 84/731 |
| 2008/0053287 | A1 * | 3/2008 | Wheeler et al. | 84/174 |
| 2008/0066607 | A1 * | 3/2008 | Stannard | 84/402 |
| 2009/0107318 | A1 * | 4/2009 | Regh | 84/291 |
| 2010/0269666 | A1 * | 10/2010 | D'Addario et al. | 84/318 |
| 2010/0269671 | A1 * | 10/2010 | Randazzo | 84/730 |
| 2010/0307313 | A1 * | 12/2010 | Zoran et al. | 84/192 |
| 2011/0197743 | A1 * | 8/2011 | Potter et al. | 84/730 |

* cited by examiner

DETACHABLE ELECTRIC PICKUP FOR MUSICAL INSTRUMENT

RELATED APPLICATIONS

This application claims the benefit under 35 USC §119(e) of the filing date of U.S. Provisional Patent Application No. 61/281,363 entitled "Musical Instrument Pickup", filed Nov. 16, 2009.

BACKGROUND OF THE INVENTION

Some musical instruments, such as basses, are rather large so that transporting them from one venue to another may be inconvenient. Also, many basses are of the acoustic type and are not fitted with electrical pickups. Accordingly, a bassist who requires amplification may have difficulty in obtaining a suitable instrument in some locations. There is a need, therefore, for a detachable electric pickup that a bassist can carry with him or her for attachment to any acoustic bass that he or she may encounter.

SUMMARY OF THE INVENTION

The present invention as described herein is particularly adapted for use with a bass, but those skilled in the art will recognize that the principles disclosed are applicable to other musical instruments as well by simply altering the sizes of the parts, and/or in some cases, by making other minor modifications.

The preferred embodiment of the invention is, in many ways, similar to a conventional "C" clamp. A piezo crystal sensor is fastened to the fixed jaw of the clamp, and the device is (removably) clamped to, preferably, the bridge of a musical instrument, such as a bass. Because of its mass, the clamp tends to remain stationary in space as the instrument bridge vibrates with the strings, causing the piezo crystal to generate a voltage signal in accordance with the string vibrations. An integral audio receptacle is built into the structure to convey the electrical audio signal generated by the pickup to an external amplifier or other device for amplifying or recording the performance. A potentiometer mounted on the device permits volume adjustment.

Removable weights are provided that can be changed by the musician to change the response of the system and control any tendency for uncontrolled feedback.

DETAILED DESCRIPTION OF TWO EMBODIMENTS OF THE INVENTION

Figure 1:
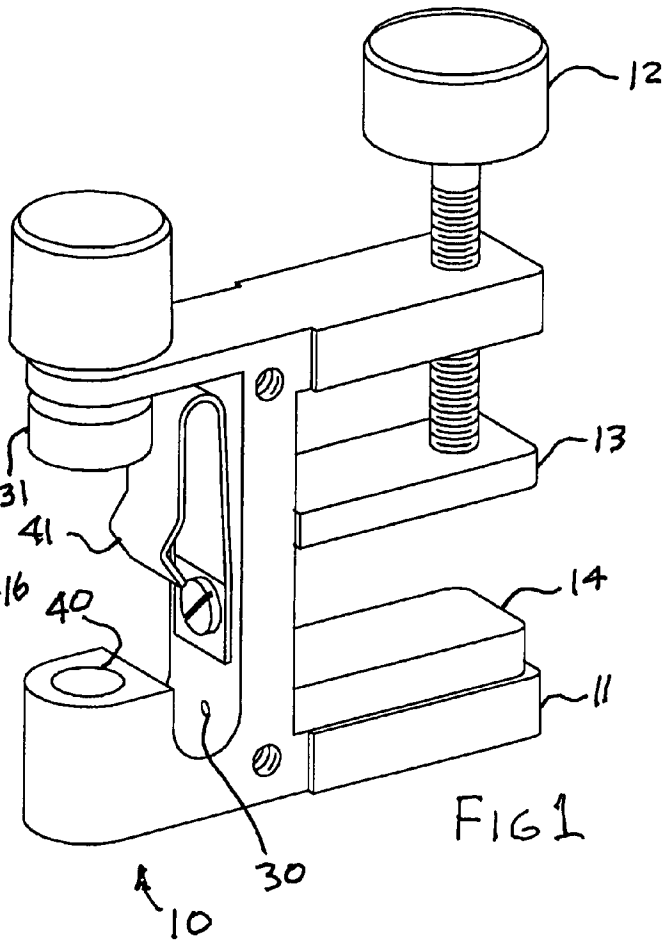
FIG. 1 is a trimetric view of one embodiment of the invention, shown without its protective cover.

Turning first to FIG. 1, the generally "C" shaped clamp body 10 of the first embodiment may be seen with its fixed jaw

11 forming the bottom of the "C". Clamping screw 12 is threaded through the top of the "C" and drives movable jaw 13. Preferably, a screw (not shown) passes up through the bottom of movable jaw 13 and into the end of screw 12 to retain the jaw to screw 12 (but permitting rotation).

Figure 2:
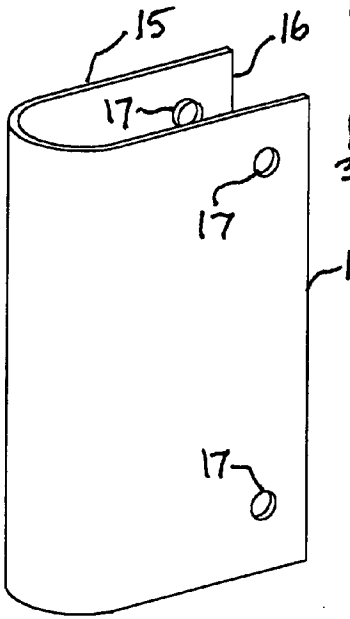
FIG. 2 is a trimetric view of a protective cover that is preferably used to protect the audio receptacle area of the device.

The edges 16 of protective cover 15 (FIG. 2) extend into the open area of the "C" and engage the end of movable jaw 13, keeping it from rotating as it is adjusted up and down by screw 12. The cover is retained by screws (not shown) through holes 17 into tapped holes 18 on the clamp body.

The sensing assembly 14 is positioned against the fixed jaw 11 and is fastened there as will be described later.

In use, the bridge of the instrument on which the invention is installed is held between the sensing element assembly 14 and movable jaw 13 by screwing down clamping screw 12. The device can be located on the bridge any place that will not interfere with the vibration of the strings, but the bass string side of the bridge is preferred. It is often convenient to clamp the device to the bass leg of the bridge. The musician may experiment with clamp location and screw tightness to achieve the tonal quality desired.

Figure 4:
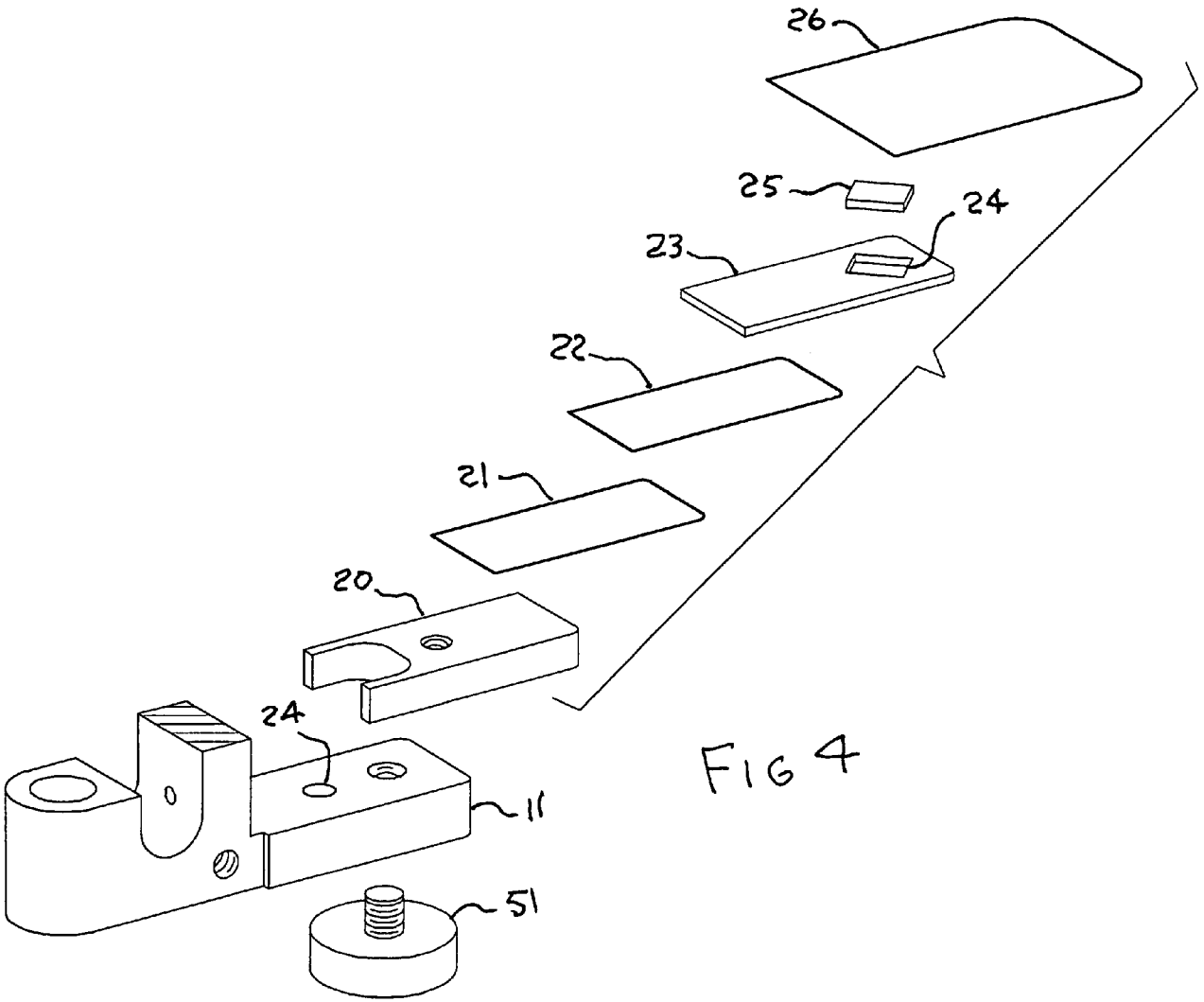
FIG. 4 is an exploded trimetric view of the sensing element assembly shown adjacent to its location on the clamp body. Only a portion of the clamp body is shown.

An exploded view of the sensing element assembly 14 can be seen in FIG. 4. A portion of the clamp body 10 can also be seen in the figure. The base member 20 of the sensing element assembly 14 is preferably made of relatively heavy material, for example, 0.125 inch thick brass. Next to the base member 20 is a sheet of insulating material 21, such as paper, followed by the "hot" foil 22, preferably copper foil. Other metals may, of course, be used. A length of insulated wire (not illustrated) is soldered to hot foil 22, and is passed through hole 30 in body 10 and then soldered to the potentiomenter 31, preferably to the wiper. Sensor retainer 23, preferably made of fiberboard or other insulating material, is positioned on top of hot foil 22. The sensor retainer has an opening 24 into which piezo crystal sensor 25 fits (loosely). Sensor retainer 23 is preferably slightly thinner than the piezo sensor. The opening 24 is preferably approximately centered under the clamping screw 12. This position has been found to provide the best overall performance.

The presently preferred sensor is part number LN851 1W603 from APC International of Mackeyville, Pa. The size of the preferred sensor is 0.200×0.160×0.040 inches, and it is designed to respond in its "shear" mode, i.e., in the 0.200 inch direction. Other sensor crystals can also be used. It has been found that positioning the sensor 25 at an approximate 45° angle with respect to the long axis of the jaw 11 usually provides the loudest and best sound. The musician can experiment with various angles and positions of the clamp on the bridge to achieve results that best suits him or her. Ground foil 26, preferably copper, covers all of the lower layers and preferably is made large enough so that its edges can fold over the sides and the exposed end of the subassembly, (whereby it acts as a shield). The edges of ground foil 26 preferably extend partially under member 20, retaining the assembly parts in place.

The sensing assembly is attached to the clamp body 10 by a screw (not shown), which comes up through hole 29 in fixed jaw 11.

Returning to FIG. 1, the clamp body 10 preferably includes a hole 40 through which the sleeve of a standard miniature audio plug can pass. A spring leaf 41 makes contact with the plug tip. The spring leaf 41 is preferably wired to the clockwise connection of the potentiometer 31, and the counterclockwise connection is connected to the body 10. None of the wiring is illustrated.

Figure 3:
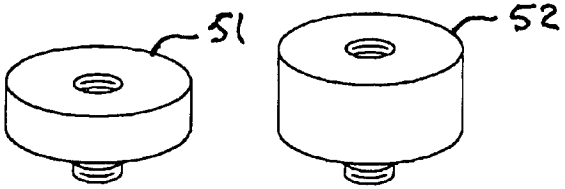
FIG. 3 is a trimetric view of two weights that may selectively be used in connection with the invention.

FIG. 3 illustrates removable auxiliary weights 51 and 52 that may be used to increase the mass of the device and, in so doing, alter the tone quality of the output signal (as well as change the signal amplitude). One or any number of the different sized weights 51 and 52 may be easily screwed on and off to achieve desired results. The term "removable" is used in the sense that the weights may be installed and/or removed, as desired, without the use of tools. Unwanted feedback is a serious issue for all amplified acoustic instruments. The different size weights may be selectively used to vary the natural frequency of the instrument bridge assembly (including the pickup installed) so as to avoid and/or control any deleterious effects of feedback.

Figure 5:
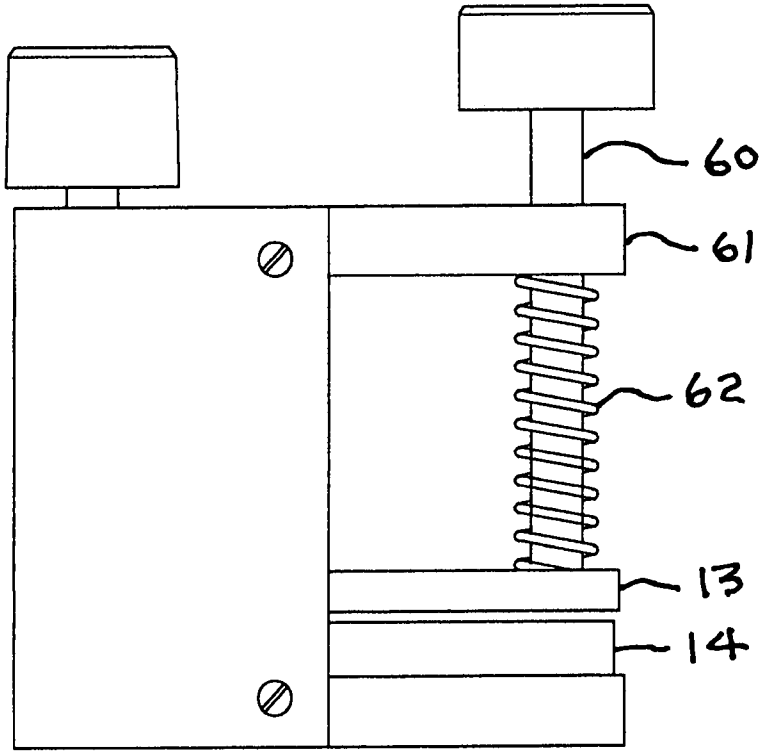
FIG. 5 is a side view of a second embodiment of the invention.

FIG. 5 illustrates a second embodiment of the invention. Instead of using a thumb screw to drive the movable jaw against the bridge, the second embodiment uses a spring to generate the clamping force. Screw 12 is replaced by a straight shaft 60 (preferably having a knob on top that can be grasped). The shaft 60 passes through a hole in the top of the body 61 (a slip fit), and is preferably fastened to movable jaw 13. A spring 62 pushes movable jaw 13 toward the sensor assembly 14, clamping the instrument bridge therebetween.

Two embodiments of the invented pickup have been described, but it will be clear to those skilled in the art that various modifications of the specific construction shown may be made that are within the scope of the invention as described by the claims. Such modifications are intended to be covered hereby.

We claim:

1. A detachable electrical pickup for a musical instrument that comprises:

a clamp including a fixed jaw and a movable jaw;

clamping means urging said movable jaw toward said fixed jaw; and a piezo crystal sensor positioned on said fixed jaw and substantially aligned with said clamping means;

wherein said fixed jaw has a long axis and said piezo crystal sensor has a rectangular shape, said piezo crystal being positioned at about 45° with respect to said long axis.

2. A detachable electrical pickup for a musical instrument as recited in claim 1 where said clamping means comprises a screw.

3. A detachable electrical pickup for a musical instrument as recited in claim 1 and further including a spring, where the clamping force driving said clamping means is derived from said spring.

4. A detachable electrical pickup for a musical instrument as recited in claim 1 and further including an output audio jack integral with said clamp.

5. A detachable electrical pickup for a musical instrument as recited in claim 4 and further including a volume control attached to said clamp.

6. A detachable electrical pickup for a musical instrument as recited in claim 1 and further including one or more weights removably attached to said clamp.

7. A detachable electrical pickup for a musical instrument as recited in claim 6 where said weights are removably attached to said fixed jaw.

8. A detachable electrical pickup for a musical instrument comprising:

a clamp;

a piezo crystal sensor attached to said clamp; and one or more weights removably attached to said clamp.

9. A detachable electrical pickup for a musical instrument as recited in claim 8 and further including an audio jack integral with said clamp.

10. A detachable electrical pickup for a musical instrument as recited in claim 9 and further including a volume control attached to said clamp.

11. A detachable electrical pickup for a musical instrument as recited in claim 8 wherein said weights are threadedly attached to said clamp.

12. A detachable electrical pickup for a musical instrument as recited in claim 8 wherein said one or more weights are comprised of at least a first weight and a second weight and wherein said first weight is removably attached to said clamp and said second weight is removably attached to said first weight.

13. A detachable electrical pickup for a musical instrument as recited in claim 12 where said weights are removably attached by threaded means.

14. A stringed acoustic musical instrument with removable electric pickup that comprises:

a stringed acoustic musical instrument that includes a string supporting bridge;

a removable clamp having a first jaw and a second jaw clamped to said bridge; and an electric pickup disposed between one of said jaws and said bridge and held against said bridge by said clamp; and one or more weights removably attached to said clamp.

15. A stringed acoustic musical instrument with removable electric pickup as recited in claim 14 wherein said weights are attached to said clamp and to each other by threaded means.

16. A stringed acoustic musical instrument with removable electric pickup as recited in claim 14 wherein said one or more weights are comprised of at least a first weight and a second weight and wherein said first weight is removably attached to said clamp and said second weight is removably attached to said first weight.

17. A stringed acoustic musical instrument with removable electric pickup as recited in claim 16 wherein said weights are attached to said clamp and to each other by threaded means.

* * * * *